US008165332B2

(12) United States Patent
Giese et al.

(10) Patent No.: US 8,165,332 B2
(45) Date of Patent: Apr. 24, 2012

(54) EARPIECE WITH BARS

(75) Inventors: Ulrich Giese, Erlangen (DE); Maja Serman, Buckenhof (DE)

(73) Assignee: Siemens Medical Instruments Pte. Ltd., Singapore (SG)

( * ) Notice: Subject to any disclaimer, the term of this patent is extended or adjusted under 35 U.S.C. 154(b) by 275 days.

(21) Appl. No.: 12/582,019

(22) Filed: Oct. 20, 2009

(65) Prior Publication Data

US 2010/0177919 A1 Jul. 15, 2010

(30) Foreign Application Priority Data

Oct. 22, 2008 (DE) ..... 10 2008 052 681

(51) Int. Cl.
*H04R 25/00* (2006.01)

(52) U.S. Cl. ..... 381/328; 381/380

(58) Field of Classification Search ..... 381/73.1, 381/328, 380

See application file for complete search history.

(56) References Cited

U.S. PATENT DOCUMENTS

| | | | | |
|---|---|---|---|---|
| 4,349,083 | A | 9/1982 | Bennett | |
| 5,031,219 | A | 7/1991 | Ward et al. | |
| 6,129,174 | A | 10/2000 | Brown et al. | |
| 6,275,596 | B1 | 8/2001 | Frentz et al. | |
| 6,860,362 | B2 | 3/2005 | Saltykov | |
| 7,236,605 | B2 | 6/2007 | Babcock | |
| 7,266,208 | B2 * | 9/2007 | Charvin et al. | 381/328 |
| 2006/0239488 | A1 | 10/2006 | Brinke | |
| 2007/0036379 | A1 | 2/2007 | Anderson | |
| 2007/0201717 | A1 * | 8/2007 | Dyer et al. | 381/380 |

FOREIGN PATENT DOCUMENTS

| | | | |
|---|---|---|---|
| EP | 1039779 | A2 | 9/2000 |
| WO | 9003089 | A1 | 3/1990 |
| WO | 9831193 | A1 | 7/1998 |

OTHER PUBLICATIONS

Dillion, "Earmolds and earshells", Hearing Aids 2001, Hoersch, Phys. Rev. 25, 225-229, 1925; Others; 1925.

Hoersch, V. A., "Theory of the Optimum Angle in a Receiving Conical Horn", Phys. Rev. 25 (1925), pp. 1-2.

Schaaf K. Ronneberger, Noise radiation from rolling tires—sound amplification by the "horn effect" Proceedings of Inter-Noise 1982, San Francisco, USA, pp. 1-5.

Stinson M.R., Daigle, G.A., "Comparison of an analytic horn equation approach and a boundary element method for the calculation of sound fields in the human ear canal", JASA Oct. 2005, 118 (4), pp. 2405-2411.

* cited by examiner

*Primary Examiner* — Brian Ensey

(57) ABSTRACT

A receiver of a hearing apparatus, especially of a hearing device, is proposed. The receiver is sufficiently centered in an auditory canal with an earpiece. The earpiece for inserting into the auditory canal has a first hollow-cylindrical body and a second hollow-cylindrical body that is arranged coaxially with the first body and surrounds the first body, as well as one or more bars that connect the two bodies to each other. On the one hand the bars ensure sufficient stability and on the other certain pliability and in addition they allow ventilation of the space in front of the eardrum.

5 Claims, 3 Drawing Sheets

EARPIECE WITH BARS

CROSS REFERENCE TO RELATED APPLICATIONS

This application claims priority of German application No. 10 2008 052 681.9 filed Oct. 22, 2008, which is incorporated by reference herein in its entirety.

FIELD OF THE INVENTION

The present invention relates to an earpiece for a hearing apparatus for insertion into an auditory canal. In general an earpiece is used for fixing a receiver tube or a receiver of a hearing apparatus into an auditory canal for example. The term hearing apparatus is understood here to mean any device which can be worn on the head or ear, in particular a hearing device, headset, earphones and suchlike.

BACKGROUND OF THE INVENTION

Hearing aids are wearable hearing apparatus used to provide assistance to those with hearing defects. To meet the numerous individual requirements, different designs of hearing aid, such as behind-the-ear (BTE) hearing aids, receiver-in-the-canal) (RIC) hearing aids and in-the-ear (ITE), hearing aids, e.g. also Concha hearing aids or canal hearing aids (ITE, CIC), are provided. The hearing aids typically listed are worn in the outer ear or in the auditory. In addition bone-conduction, implantable or vibro-tactile hearing aids are also available on the. In such cases the damaged hearing is stimulated mechanically or electrically.

Hearing devices are wearable hearing apparatuses which are used to assist the hard-of-hearing. In order to accommodate numerous individual requirements, various types of hearing devices are available such as behind-the-ear hearing devices (BTEs), hearing device with an external receiver (RIC: receiver in the canal) and in-the-ear hearing devices (ITE), for example also concha hearing devices or completely-in-the-canal hearing devices (ITE, CIC). The hearing devices listed as examples are worn on the outer ear or in the auditory canal. Bone conduction hearing aids, implantable or vibrotactile hearing aids are also available on the market. In these devices damaged hearing is stimulated either mechanically or electrically.

The key components of hearing devices are principally an input converter, an amplifier and an output converter. The input converter is normally a receiving transducer e.g. a microphone and/or an electromagnetic receiver, e.g. an induction coil. The output converter is most frequently realized as an electroacoustic converter e.g. a miniature loudspeaker, or as an electromechanical converter e.g. a bone conduction hearing aid. The amplifier is usually integrated into a signal processing unit. This basic configuration is illustrated in FIG. 1 using the example of a behind-the-ear hearing device. One or more microphones 2 for recording ambient sound are built into a hearing device housing 1 to be worn behind the ear. A signal processing unit 3 which is also integrated into the hearing device housing 1 processes and amplifies the microphone signals. The output signal for the signal processing unit 3 is transmitted to a loudspeaker or receiver 4, which outputs an acoustic signal. Sound is transmitted through a sound tube, which is affixed in the auditory canal by means of an otoplastic, to the device wearer's eardrum. Power for the hearing device and in particular for the signal processing unit 3 is supplied by means of a battery 5 which is also integrated in the hearing device housing 1.

The centering of receivers of RIC (receiver in the canal; hearing aid with external receiver) depends on a number of circumstances. Mostly the centering depends on the shape of the auditory canal. Provided there is a sufficiently large amount of space in the auditory canal, the centering of the receiver also depends on an equilibrium between the forces exerted on the receiver by the rest of the hearing system and the rigidity of the earpiece. The current normal standard receivers are too soft to be able to guarantee a sufficient centering, if the structure of the auditory canal is difficult and/or if high forces from the rest of the hearing system act on the receiver. Such problems occur in particular with what are known as cymba hearing devices, which need the earpiece in the auditory canal as an essential support point so that they can be worn stably on the ear or in the cymba. With conventional components the forces exerted on the receiver are often so high that it is pressed into the auditory canal wall. If the receiver is located well away from the center axis of the auditory canal however, i.e. it is not centered, this leads to problems for the wearer, especially to inflammation of the auditory canal wall.

In addition an eccentrically arranged receiver can also have noticeable acoustic effects. In particular receivers that do not lie precisely in the center of the auditory canal frequently lead to increased feedback. The result of this is that the amplification of the hearing loss has to be reduced. Compensation for the hearing loss is then not at its optimum.

Previously two different types of closed standard earpieces have been used. The type used depends on the receiver type employed. With smaller receivers (45 and 55 dB) only an output power and amplification that is too low at high frequencies is possible with normal earpieces. In addition the closed standard earpieces lead to so-called occlusion effects.

SUMMARY OF THE INVENTION

The object of the present invention is thus to further suppress feedback in hearing apparatuses.

Inventively this object is achieved by an earpiece for a hearing apparatus for insertion into an auditory canal comprising a hollow-cylindrical first body, a hollow-cylindrical second body that is arranged coaxially with the first body and encloses the first body, and also one or more bars connecting the two bodies to each other.

Advantageously the bar or bars make it possible for the earpiece to be embodied sufficiently rigid, so that any receiver worn in front of the earpiece can be arranged centered in the auditory canal, by which the majority of feedback can be avoided. The robust embodiment of the earpiece that leads to a better centering of the receiver is also the reason in acoustic terms for improved speech comprehensibility and sound quality. But the improved centering also leads to increased comfort for the wearer.

Preferably the bar or bars runs or run in an axial direction of the two bodies. This means that even more account is taken of the centering function.

The inventive earpiece can be manufactured in one piece as an injection-molded part. This results in a minimal manufacturing outlay for the earpiece.

In accordance with a particular embodiment the two bodies can be joined on a front face side by a wall along their entire circumference. In particular the wall can be embodied concave. This imparts an additional strengthening function to the earpiece, since a concave wall directed towards the eardrum exercises a horn effect that is well known in the area of acoustics. The amplification effect that is able to be achieved here, especially in higher frequency ranges, allows lower-power receivers to be used.

Furthermore the wall can have at least one cutout so that air can penetrate through from one end face side to the other between the two bodies and through the at least one cutout. This enables an occlusion effect to be effectively avoided.

Preferably a hearing apparatus which possesses an external receiver can be equipped with an inventive earpiece as presented above. In particular it is advantageous to provide a cymba device with such an earpiece or dome.

BRIEF DESCRIPTION OF THE DRAWINGS

The present invention will now be explained on the basis of the enclosed drawings, in which the figures show.

DETAILED DESCRIPTION OF THE INVENTION

The exemplary embodiments described in greater detail below represent preferred embodiments of the present invention.

Figure 1:
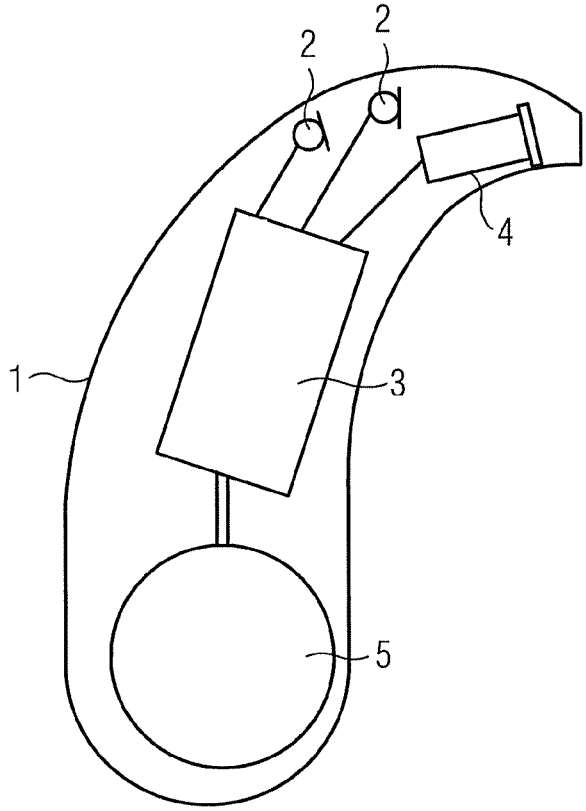
FIG 1 (Prior art)
FIG. 1 a basic diagram of the structure of a prior art hearing device.
Figure 2:
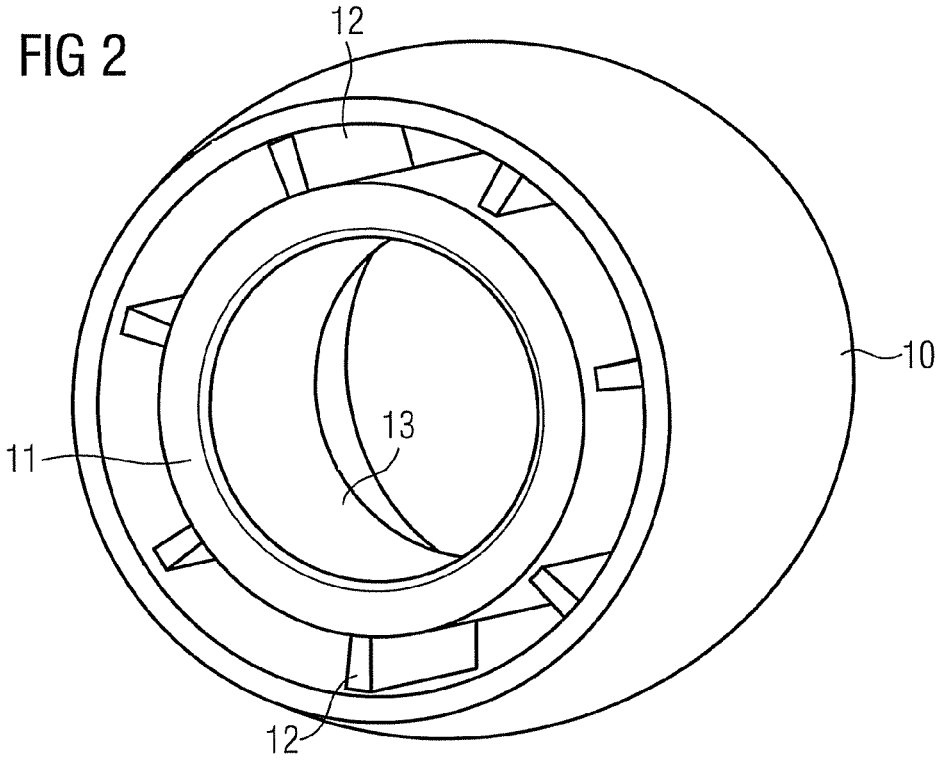
FIG. 2 an inventive earpiece viewed from an end face side.

FIG. 2 shows an earpiece such as can be placed on an external receiver of a hearing device. The earpiece serves to fix the receiver in the auditory canal as centrally as possible.

Essentially the earpiece from the example of FIG. 2 consists of a hollow-cylindrical outer body 10 and a hollow-cylindrical inner body 11. Both bodies are arranged coaxially to each other the inner body 11 is located here entirely within the outer body 10, i.e. within the external contour or the envelope of the outer body 10. Naturally it is quite possible for the inner body 11 to project axially from the outer body 10.

The inner body 11 and the outer body 10 are connected to each other by bars 12. In the present example seven bars are provided, which run in an axial direction in relation to the two hollow-cylindrical bodies 10 and 11.

FIG. 2 shows the earpiece from that end face side which points outwards when it is worn within the auditory canal. The receiver not shown in FIG. 2 is then located in the circular cutout 13 when the hearing device is worn.

Figure 3:
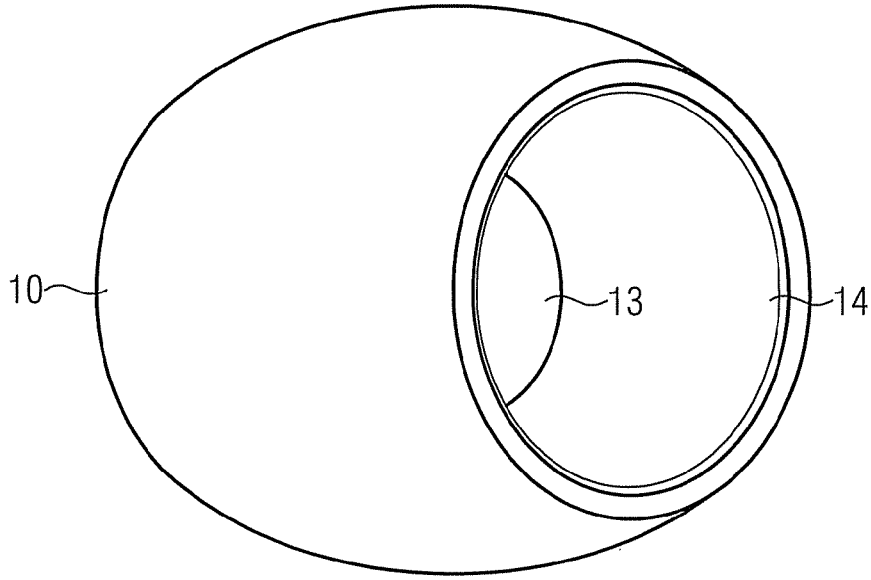
FIG. 3 the earpiece from FIG. 2 viewed from the other end face side.

FIG. 3 shows the earpiece of FIG. 2 at an angle from the opposite end face side, i.e. from that end face side that points towards the eardrum when the earpiece is worn. From this perspective a concave wall 14 can be seen that joins the outer body 10 to the inner body 11 around the entire circumference. This concave wall is directed towards the eardrum when the earpiece is being worn and exercise the described horn effect, with high frequencies of the sound being amplified (Dillon, H. Hearing Aids 2001, Hoersch, V. A. "Theory of the Optimum Angle in a Receiving Conical Horn, Phys. Rev 25, 225-229, 1925, Schaaf K, Ronneberger. D:" Noise radiation from rolling tires—sound amplification by the "horn effect"; Proceedings of Inter-Noise 1982, San Francisco, USA; Stinson M R, Daigle G A "Comparison of an analytic horn equation approach and a boundary element method for the calculation of sound fields in the human ear canal". JASA 2005, 118(4):2405-11). Speech quality and also the perceived sound quality are improved by the horn effect since the high-frequency component of a signal is not lost and the respective receiver employed operates below its power limit range.

Figure 4:
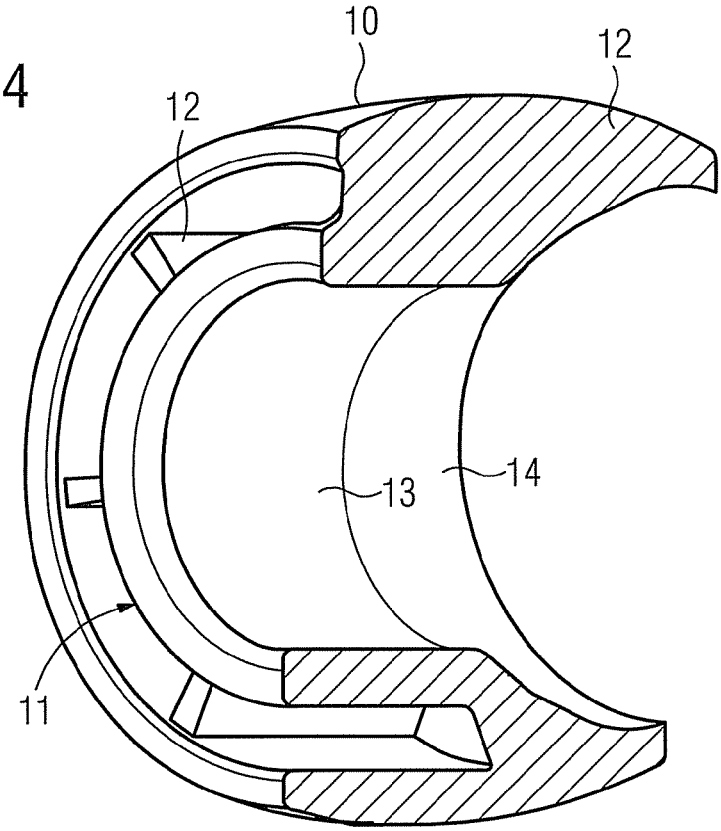
FIG. 4 the earpiece from FIG. 2 shown in cross section.

FIG. 4 shows the earpiece of FIG. 2 in cross-sectional view. The bars 12 as well as the spaces between the hollow cylinders 10 and 11 are easily visible in this diagram.

Figure 5:
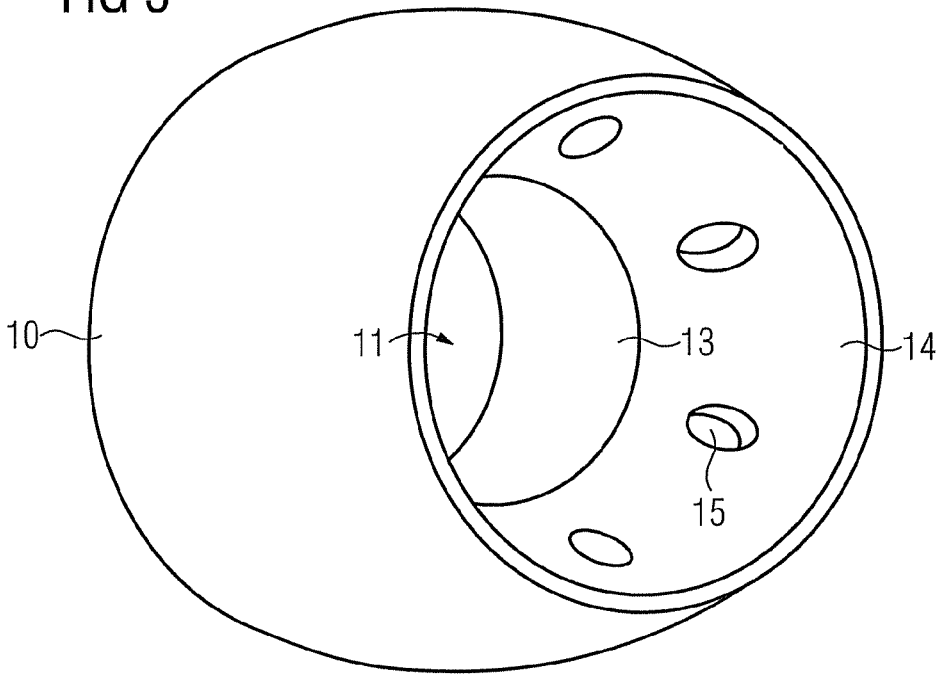
FIG. 5 an inventive earpiece in accordance with a second embodiment, viewed from an end face side and FIG. 6 the earpiece from FIG. 5 viewed from the other end face side.
Figure 6:
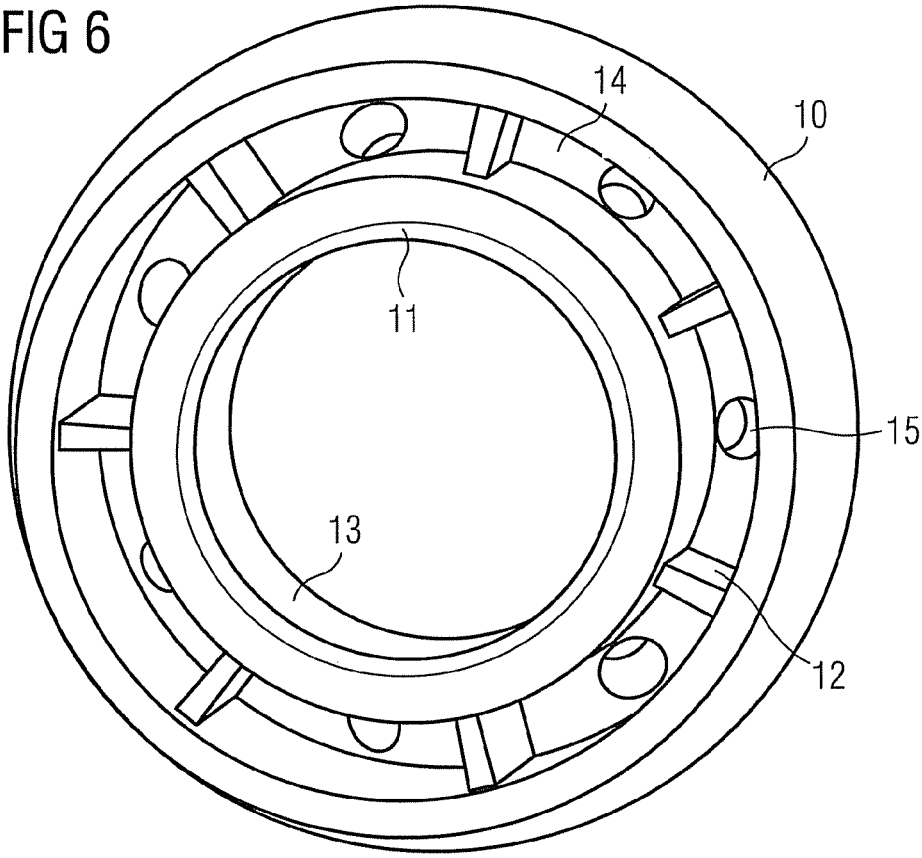

FIGS. 5 and 6 show a further exemplary embodiment of an inventive earpiece from different perspectives. FIG. 5 shows the earpiece at an angle from the front, i.e. from the side that points towards the eardrum when the earpiece is in the inserted state. The structure of this earpiece essentially corresponds to that of the earpiece depicted in FIG. 2 through 4. It thus also has a barrel-shaped outer part 10, an annular inner part 11 and a concave wall 14. However a number of cutouts 15 are provided here in the concave wall 14 distributed around the circumference.

The structure of the earpiece can be seen more clearly in the longitudinal section depicted in FIG. 4. On the one hand this diagram particularly shows the structure of the bars 12 as well as the structure of the cavities between the outer part 10 and the inner part 11 and the bars 12. A good view of the concave structure of the wall 14 can also be seen.

FIG. 6 shows the earpiece from FIG. 5 from the rear side, i.e. from the side pointing out of the auditory canal when the earpiece is being worn. In this perspective the bars 12 which join the outer part 10 to the inner part 11 can again be seen. A cutout 15 is further to be seen between two respective bars. The cutouts 15 thus make an exchange of air possible from the space between the bar including receiver and the eardrum to the outside environment, since each cutout 15 opens a respective space in the earpiece that is delimited by the outer part 10 and the inner part 11 as well as two adjacent bars 12 forwards or in the direction of the eardrum. Outwards or backwards this space is open in any event.

As shown in the example of FIGS. 2 to 4 the earpiece in accordance with the example of FIGS. 5 and 6 is comparatively robust compared to prior art earpieces as a consequence of its rib or bar structure. These ribs, which run parallel to the auditory canal, make the earpiece, as mentioned, robust enough to achieve an adequate centering of the receiver, and on the other hand they leave it soft enough to take account of the auditory canal anatomy. At least three ribs or bars 12 should be provided, but there could also be between four and seven and if necessary even more, which also depends on the degree of softness of the material.

In the present example just as many cutouts 15 as bars 12 are provided. However the number of the bars is basically independent of the number of the cutouts 15. The latter are merely to be dimensioned in their number and their size so as to provide a sufficiently great ventilation effect or preventing any occlusion effect as far as possible.

The invention claimed is:

1. An earpiece for a hearing apparatus to be inserted into an auditory canal of a user, comprising:

a hollow-cylindrical first body;

a hollow-cylindrical second body that is arranged coaxially with the first body and surrounds the first body; and a bar that connects the first body to the second body, wherein the first body is connected to the second body on an end face side of the earpiece by a wall along an entire circumference, and wherein the wall comprises a cutout that opens a space in the earpiece to pass through air so that the air penetrates between the first body and the second body from one end face side of the earpiece to another end face side of the earpiece.

2. The earpiece as claimed in claim 1, wherein the bar runs in an axial direction of the first body and the second body.

3. The earpiece as claimed in claim 1, wherein the earpiece is manufactured in one piece as an injection-molded part.

4. The earpiece as claimed in claim 1, wherein the wall is a concave wall.

5. A hearing device, comprising:

an external receiver; and an earpiece arranged on the external receiver, wherein the earpiece comprises:

a hollow-cylindrical first body;

a hollow-cylindrical second body that is arranged coaxially with the first body and surrounds the first body; and a bar that connects the first body to the second body, wherein the first body is connected to the second body on an end face side of the earpiece by a wall along an entire circumference, and wherein the wall comprises a cutout that opens a pace in the earpiece to pass through air so that the air penetrates between the first body and the second body from one end face side of the earpiece to another end face side of the earpiece.

* * * * *